United States Patent [19]

Schaper et al.

[11] 4,422,006

[45] Dec. 20, 1983

[54] ELECTROCHEMICAL LUMINESCENT CELL

[75] Inventors: Hartwig Schaper, Roetgen; Karl H. Wilhelm, Aachen, both of Fed. Rep. of Germany

[73] Assignee: U.S. Philips Corporation, New York, N.Y.

[21] Appl. No.: 271,301

[22] Filed: Jun. 8, 1981

[30] Foreign Application Priority Data

Sep. 6, 1980 [DE] Fed. Rep. of Germany ..... 3021587

[51] Int. Cl.[3] ..... H01K 1/52

[52] U.S. Cl. ..... 313/483; 313/547; 313/358

[58] Field of Search ..... 313/174, 483, 358, 549, 313/554, 556, 560, 561, 547; 252/299.2, 188.3 CL

[56] References Cited

U.S. PATENT DOCUMENTS 3,319,132 5/1967 Chandross et al. ..... 313/358

3,888,784 6/1975 Pighin et al. ..... 252/188.3 CL

*Primary Examiner*—Palmer C. Demeo

*Assistant Examiner*—Sandra L. O'Shea

*Attorney, Agent, or Firm*—Norman N. Spain

[57] ABSTRACT

Electrochemical luminescent cell with a getter material.

6 Claims, 2 Drawing Figures

ELECTROCHEMICAL LUMINESCENT CELL

Figure 1:
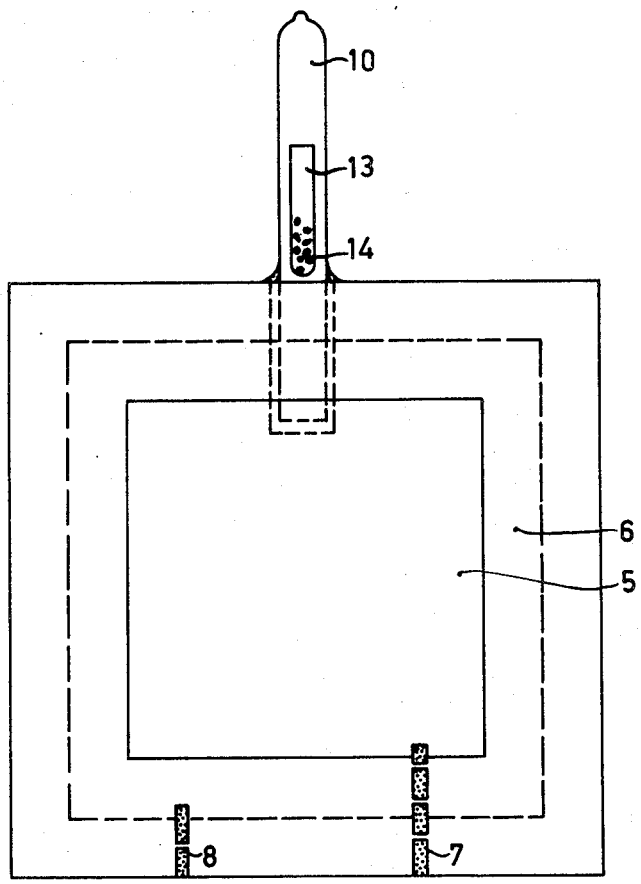

The invention relates to an electrochemical luminescent cell having a fill which contains an electrochemical luminescent material and a solvent and, possibly, a conductive salt as the filling components.

Electrochemical luminescence (ECL) is a continuous conversion of electrical energy into light. The basic principle of the ECL in the visible range of the spectrum is the formation of molecules or ions R in an electronically excited state $R^*$ by suitable chemical reactions or electrode reactions from reactants, for example $R^+$ or $R^-$, which are electrochemically produced from their starting compounds R. In the actual luminescence, $R^*$ returns, while emitting light, to the basic form R. The theoretical principles of cells of this type are known from, for example, the book by Weissberger and Rossiter "Physical methods of Chemistry", volume II B (1971), pages 257 etc.

There are two different types of electrochemical luminescent cells, namely a type which is operated with D.C. voltage (DE-OS 2,356,940) and a type which is operated with A.C. voltage (DE-AS 1,243,269). In D.C. operation electrolysis anions and cations are produced at two different electrodes. Such generally at least one type of ions is relatively unstable, i.e. it enters into side reactions with the solvent or the admixed conductive salt or disproportionates, the anode and the cathode must be very close to each other to enable recombining in a short period of time. These restrictions are avoided in A.C. operation as anions and cations in consecutive time intervals are produced at only one electrode and can react with each other in the immediate vicinity of the electrode.

Both with direct current and alternating current cells the side reactions of the radical ions $R^+$ and $R^-$ gradually result in a consumption of the luminous materials R or in the occurrence of products promoting deenergization of the electronically excited states without radiation being produced and which thus reduces the efficiency of the cell. Contaminants in the ECL-cells which are particularly disadvantageous for the luminescence are water and oxygen. In view of the technical application of ECL-cells, for example as light sources or display elements, there also should be a guarantee that the ECL solutions remain free, for long periods of time, from disturbing contaminations such as, inter alia, water or oxygen. There is a special risk that due to any leakages, however small, of the ECL-cell vessels traces of oxygen and water may penetrate into the solution and contaminate it.

A further source of contaminations may be the filling operation of the ECL-cells themselves. Owing to the light transmission, the high chemical resistance and their inherent very high need of being gas-tight, glass is preferably used as the material for ECL-cells and the cell apertures are advantageously closed by sealing, after the solutions have been brought into the cells. During melting of glasses, soft glasses in particular, not inconsiderable quantities of water may however be released. In addition, constituents of the ECL-solution (for example solvent vapour) might be pyrolytically decomposed as a result of which decomposition products which have a disadvantageous effect on the electrochemical luminescence might be released (for example olefines, carbon monoxide, water and nitrogen oxides).

This problem is the subject of U.S. Pat. No. 3,888,784, from which it is known to impose very high requirements on all the materials to be used in ECL-cells as regards their purity. Consequently, before the cell is actually finished, oxygen and water must be especially removed, which may be done by means of a heat treatment in vacuum or a similar operation. It will, however, not be possible to avoid the possibility that a very small residue of contaminations stays behind and, that during filling of the cell vessel, contaminations are supplied again, even if this filling operation is done in a protective gas atmosphere.

In the interest of a long operating life of ECL-cells, the invention has therefore for its subject to intercept contaminations such as residual contaminations of the filter solution or contaminations which may penetrate into the cell vessel through very small leaks or are introduced during filling or sealing of the cells, and also side products produced during the actual ECL-operation, also after the cell has been finished and during operation of the cells.

According to the invention an electrochemical luminescent cell as described in the introductory part is characterized in that the cell contains a getter material which does not react with the filling components, and which chemically or physically binds contaminations present in the cell or converts them into compounds which do not cause disturbances.

In this manner it is achieved that during the whole operating life the ECL-cells remain free from disturbing contaminations.

The getter materal may either be contained in the solvent itself or be in contact with the gas inside the cell. In the latter case the cell preferably has a feed pipe in which the getter material is accommodated. To ensure efficient operation the getter material is contained in a small tube which is closed at one end and housed in the feed pipe.

Chemically acting getter materials may be for example base metals, pure or in the form of their interstitial compounds, for example $C_8K$ or $C_{24}K$, or their alloys, for example Pb/Na, reducing agents, for example $CrSO_4$, alkaline and alkaline earth hydrides as well as hydroquinone or transition metal compounds, for example $C_5H_5Cr(CO)_3H$.

Physically acting getters will generally be adsorption or absorption active materials, such as molecular sieves, silicagel, aluminum oxide, active carbon or similar materials.

Figure 2:
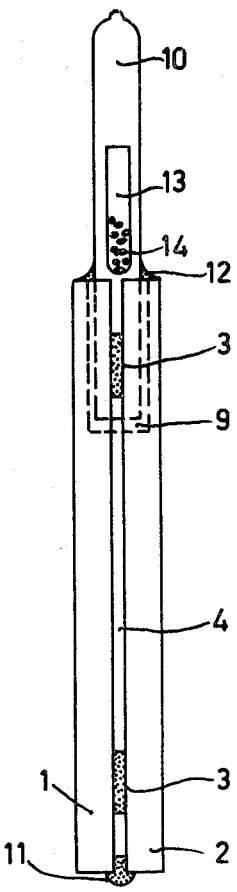

An embodiment of the invention will now be further described by way of a non-limitative example with reference to the drawing, in which FIG. 1 is an elevational view of a thin-film ECL-cell and FIG. 2 is a side elevational view of the cell of FIG. 1.

The ECL-cell is formed from two plane-parallel glass plates 1 and 2 which are separated from each other by a thin spacer 3 which at the same time limits the interior 4 of the cell. In the area of the interior 4 of the cell, electrodes 5 and 6, respectively are provided on the interior side of the glass plates 1 and 2 by means of thin film technology, contact paths 7 and 8 forming the electrical connection leading from the electrodes to the edge of the glass plates 1 and 2. At the top of the cell a hole 9, which extends into the cell interior 4 is provided in the glass plates 1 and 2. A feed pipe 10 which serves for filling the cell with ECL-solution in a suitable protective gas arrangement is positioned in said hole 9. The cell is sealed by means of seals 11 and 12 in accordance with the requirements of high-vacuum technology. The interior 4 of the ECL-cell is filled with a solution of rubrene (5, 6, 11, 12-tetraphenyl tetracene) in 1,2-dimethoxyethane, which is free of electrolyte. The cell is operated with direct current from a D.C. voltage source of approximately 3 Volts. Such a cell is disclosed in the prior German Patent Application P 29 49 967,0.

In the ECL-cell in accordance with the invention, a thin tube 13 which is closed at one end and contains a small quantity of $C_8K$ as the getter material 14 after the cell has been filled with the solution, is inserted into the feed pipe 10, which is thereafter sealed. The getter material 14 is in contact with the vapour of the solvent and the residual protective gas in the cell. This ensures a perfect, irreversible reaction with oxidizing contaminants (for example oxygen) or proton-producing contaminants (for example water) during operation of the cell. The getter material operates as follows:

$$C_8K + \tfrac{1}{4}O_2 \rightarrow \tfrac{1}{2}K_2O + 8C$$

$$C_8K + H_2O \rightarrow KOH + \tfrac{1}{2}H_2 + 8C$$

Compared with a similar ECL-cell which, however, does not contain a getter material and which stops working soon after 50 hours, the operating life of the ECL-cell in accordance with the invention is increased by a factor of 3 to 4.

What is claimed is:

1. An electrochemical luminescent cell having a fill which contains an electrochemical luminescent material and a solvent as the filling components, characterized in that the cell contains a getter material which does not react with the filling components, and which chemically or physically binds contaminations present in the cell or converts them into compounds which do not cause disturbances.

2. An electrochemical luminescent cell as claimed in claim 1, characterized in that the getter material is contained in the solvent itself.

3. An electrochemical luminescent cell as claimed in claim 1, characterized in that the getter material is in contact with the gas phase inside the cell.

4. An electrochemical luminescent cell as claimed in claim 3, characterized in that the cell has a feed pipe in which the getter material is accommodated.

5. An electrochemical luminescent cell as claimed in claim 4, characterized in that the getter material is present in a tube which is closed at one end and housed in the feed pipe.

6. An electrochemical luminescent cell as claimed in claim 1 wherein the cell contains a conductive salt as a filling component.

* * * * *

UNITED STATES PATENT AND TRADEMARK OFFICE

CERTIFICATE OF CORRECTION

PATENT NO. : 4,422,006

DATED : December 20, 1983

INVENTOR(S) : HARTWIG SCHAPER ET AL

It is certified that error appears in the above-identified patent and that said Letters Patent is hereby corrected as shown below:

On the title page [30]

"Sep. 6, 1980" should be --June 9, 1980--.

Signed and Sealed this

*Seventeenth* Day of *July 1984*

[SEAL]

*Attest:*

GERALD J. MOSSINGHOFF

*Attesting Officer*

*Commissioner of Patents and Trademarks*